United States Patent [19]

Schneider et al.

[11] 4,063,665

[45] Dec. 20, 1977

[54] SUPPLY CONTAINER AND DISPENSING UNIT ASSEMBLY

[75] Inventors: Barry Schneider, Crystal Lake, Ill.; Steven Bernard, Palos Verdes Peninsula, Calif.

[73] Assignee: Chemtrust Industries Corporation, Franklin Park, Ill.

[21] Appl. No.: 748,055

[22] Filed: Dec. 6, 1976

[51] Int. Cl.[2] ..... B65D 1/04

[52] U.S. Cl. ..... 222/129; 222/187; 239/57

[58] Field of Search ..... 222/187, 182, 129; 239/34, 37, 38, 43, 57, 53

[56] References Cited

U.S. PATENT DOCUMENTS

| | | | |
|---|---|---|---|
| 1,737,532 | 11/1929 | Allen | 239/34 X |
| 2,610,769 | 9/1952 | Goetz | 222/187 |
| 3,235,132 | 2/1966 | Patton et al. | 222/182 |

FOREIGN PATENT DOCUMENTS

| | | | |
|---|---|---|---|
| 355,880 | 7/1922 | Germany | 239/37 |

*Primary Examiner*—Stanley H. Tollberg
*Attorney, Agent, or Firm*—Wallenstein, Spangenberg, Hattis & Strampel

[57] ABSTRACT

A container holding a supply of a volatile liquid material to be poured therefrom includes an upper pouring spout-forming section over which, in the preferred form of the invention, is placed a removable attachment unit which appears to be a vertical cap-forming continuation of the top of the container. The attachment unit preferably has a compartment opening to the outside thereof and containing a liquid-absorbing material into which a portion of the liquid volatile material of the container is ultimately poured when the attachment is removed from the container. In a less preferred form of the invention, the dispensing unit-forming attachment is removably attached to and preferably forms a vertical continuation of the bottom of the container.

13 Claims, 7 Drawing Figures

SUPPLY CONTAINER AND DISPENSING UNIT ASSEMBLY

BACKGROUND OF INVENTION

Deodorant and other volatile liquid materials dispensed by governmental, institutional and commercial establishments are generally packaged in relatively large supply containers and the liquid is poured from the supply containers into smaller dispensing units from which the material gradually volatilizes and escapes into the surrounding atmosphere. The present invention uniquely combines the supply and container dispensing units into a single package assembly.

SUMMARY OF INVENTION

In accordance with one form of the invention, a supply container for a volatile liquid is provided comprising a cylindrical body with a reduced, sealed, openable, pouring spout-forming upper section closing off the upper end thereof and a sealing wall closing off the bottom end thereof. Most preferrably, the upper end of the container is provided with a combination detachable cap and dispensing unit appearing as a vertical extension of the cylindrical container body. Initially, the spout-forming section of the supply container is sealed by a cap or a puncturable upper wall which, upon removal of the combination cap and dispensing unit and a sealing cap initially covered by the combination cap and dispensing unit, can be punctured to form a pouring opening through which a limited amount of the volatile liquid material in the supply container is poured into an opening in the combination cap and dispensing unit. In another form of the invention, the dispensing unit is formed by an attachment unit removably connected to the bottom end portion of the supply container where it preferably appears as a vertical continuation of the cylindrical container body and a mirror image of an upper detachable cap appearing as a vertical extension of the upper end of the cylindrical container body.

In both forms of the invention just described, it may include a generally cup-shaped body adapted to envelope and make a snap-fit on the upper or bottom end portion of the container body. One end portion of the dispensing unit forms a support base for the same when it is removed from the supply container and the opposite end thereof has one or more apertures therein through which the volatile liquid material from the supply container can be poured. A liquid-absorbent material is placed in the dispensing unit body interior for absorbing the liquid so that a large surface area is presented to provide adequate amounts of material released into the surrounding atmosphere and so that no flowable body of liquid is present to spill should the dispensing unit be knocked over inadverdently.

In the most preferred form of the invention where the dispensing unit appears as a vertical extension on the top of the supply container body, the dispensing unit preferably has a perforated upper wall forming the liquid-receiving end of the unit and, to minimize the vertical dimensions of the dispensing unit, a deeply concave upwardly extending bottom wall following the outlines of the reduced upper end portion of the supply container. An annular compartment is defined between the deeply concave bottom wall and cylindrical side walls of the dispensing unit.

The above and other features and advantages of the invention will become apparent when makng references to the specification to follow, the claims and the drawings.

DESCRIPTION OF DRAWINGS

FIG. 2 illustrates the dispensing unit of FIG. 1 removed from the bottom end portion of the supply container shown in FIG. 1 and inverted to expose a liquid-receiving opening in the upper portion thereof for receiving a volatile liquid poured from the punctured, spout-forming upper end portion of the supply container shown in FIG. 1, after removal of the outer and inner caps there from;

DESCRIPTION OF EXEMPLARY FORMS OF THE INVENTION

Figure 1:
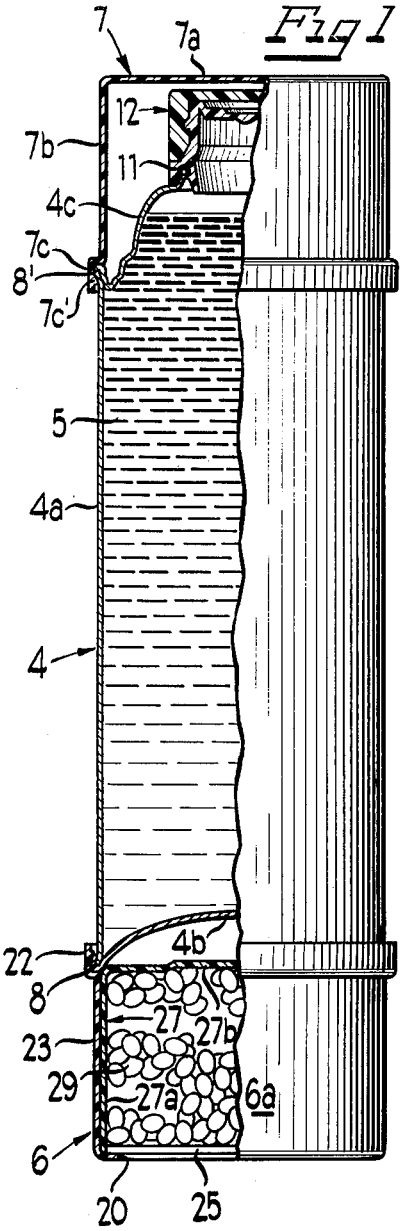
FIG. 1 is a broken-away partly vertical elevational and sectional view of one form of a combination supply container and dispensing unit assembly of the present invention where the dispensing unit is an attachment unit on the bottom of the supply container.

Referring now more particularly to FIG. 1, the form of the invention thereshown is supply container and dispensing unit assembly comprising a supply container 4 of a shape and construction similar to that found on commercially available aerosol containers but having a volatile liquid 5 therein, like a volatile deodorant material. The upper end of the container 4 has the usual external cover or cap 7 forming a vertical continuation or extension of the upper end of the supply container, and a unique deodorant material dispensing unit 6 to be described which forms an attachment unit and a vertical continuation or extension of the bottom of the supply container.

The supply container illustrated is formed by a cylindrical metal body **4*a* forming the vertical side walls of the supply container as viewed in FIG. 1. The bottom of the body 4*a* is closed by bottom wall 4*b* secured to the bottom margin of the body 4*a* by a rolled beaded joint 8. The supply container has an upper metal closure wall 4*c* joined to the upper margin of the body through a rolled beaded joint 8'. The wall 4*c* terminates at its upper end in a beaded rim 11 over which is snap-fitted a spout-forming member 10 which may be made of a molded synthetic plastic material. The spout-forming member 10 has a cylindrical body portion 10*a* terminating at the bottom thereof in a flanged portion 10*b* having an annular groove 13 opening onto a larger annular recess 10*c* and adapted to be snap-fitted over the beaded upper edge 11 of the upper closure wall 4*c* of the supply container. The spout-forming member 10 has a recessed upper wall 10c having a thin center section 10c' adapted to be punctured with a screw driver, ice pick or the like. The spout-forming member 10 has external threads 17 thereon over which is mounted a sealing cap 12 to seal the supply container after the spout-forming member 10** is punctured as described.

The cap 7, which covers the upper end of the supply container 4 as illustrated, forms a vertical extension and continuation of the cylindrical metal body 4a. It is preferably made of a molded synthetic plastic material. The cap 7 has a cylindrical wall 7b terminating in a flanged portion 7c with internal locking projections 7c' snap-fitted under the beaded joint 8. The wall 7b, which is preferably in vertical alignment with the cylindrical body 4a of the supply container, terminates in an imperforate upper wall 7a locates slightly above the sealing cap 12.

In accordance with the present invention, a unique combination of a supply container and a dispensing unit is provided by designing the dispensing unit as an attachment unit to the supply container. In the form of the invention shown in FIGS. 1 through 5, the attachment unit 6 appears as a vertical downward continuation of the cylindrical body 4a of supply container 4 and resembles in appearance the cap 7, so that the supply container has an attractive symmetry.

While in accordance with other aspects of the present invention, the attachment unit 6 may take a variety of forms, as illustrated, in FIGS. 1 through 5 it comprises a main cup-shaped member 6a which is a duplicate of the cap 7 except that a large opening 20 is formed or cut in its outer wall 21. The cup-shaped member 6a has cylindrical side walls 23 terminating in one end in the apertured wall 21 and at its opposite end is a flange 22 defining an opening 22'. The inner surface of the flange 22 has locking nibs 24 which makes a snap-fitting engagement over the beaded joint 8 at the bottom end of the cylindrical body 4a of the supply container.

When attachment unit 6 has the orientation shown in FIG. 1, where it is attached to the supply container, the apertured outer wall 21 thereof is at the bottom of the attachment unit. Supported in the opening 20 of the wall 21 adhesively or otherwise is a liquid-permeable layer of material 25, which may take a variety of forms. For example, it may be made of a non-woven filter material commonly found in furnace filters, or it could simply be an apertured disc of synthetic plastic material or the like utilized in other forms of the invention to be described.

Figure 5:
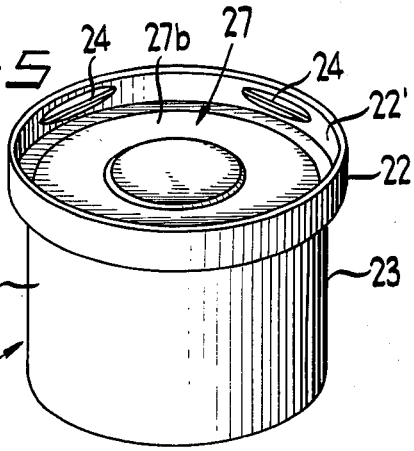
FIG. 5 is a perspective view of the dispensing unit of FIG. 1 before it is inverted into the liquid receiving position shown in FIG. 2.

Friction-fitted within cup-shaped member 6a by insertion through the flange opening 22' is a cup-shaped liner member 27 with its open end opposite the opening 20 in the outer wall of the cupshaped member 6a. The liner member has vertical side walls 27a friction-fitted within the interior of the cylindrical side walls 23 of the cup-shaped member 6a, an end wall 27b which, when viewed in FIGS. 1 or 5, is positioned immediately below the locking nibs 24 projecting inwardly from the flange 22 of the cup-shaped member 6a. Supported within the liner member 27 is a suitable liquid-absorbent material 29 which, for example, may be made of corn cobs chopped into small pieces, as illustrated.

Figure 2:
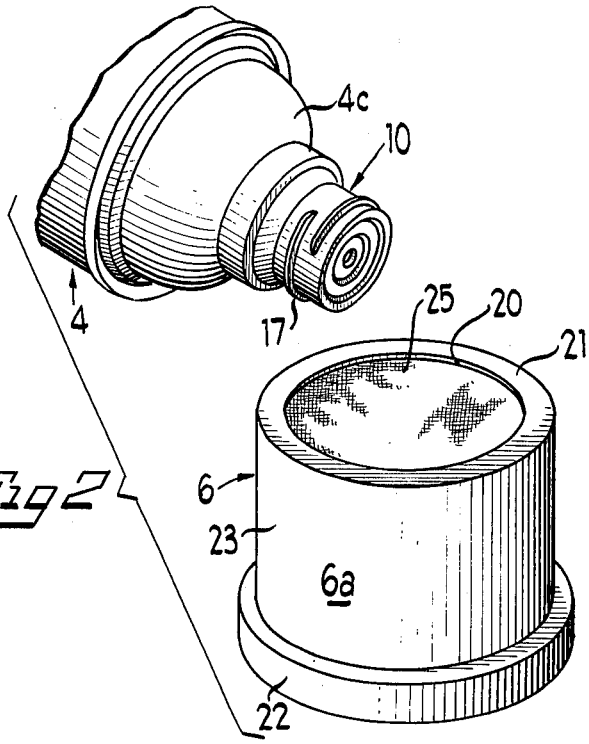
Figure 3:
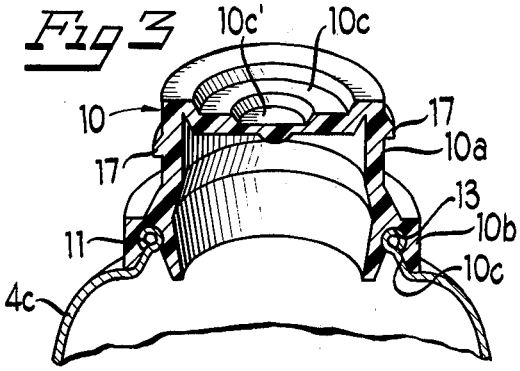
FIG. 3 is a fragmentary perspective and vertical sectional view of the spout-forming upper end portion of the supply container of FIG. 1.
Figure 4:
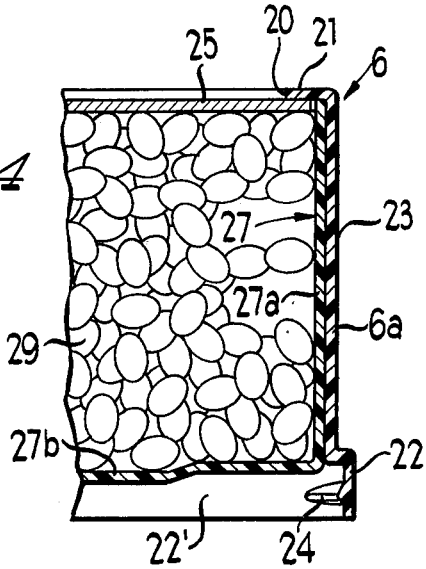
FIG. 4 is a greatly enlarged fragmentary vertical sectional view through the dispensing unit shown in FIG. 2.

The purchaser of the supply container and dispensing unit assembly shown in FIG. 1 is instructed to remove the attachment unit 6 from the bottom of the supply container and invert the same as shown in FIGS. 2 and 4, so that the opening 20 in the outer wall 21 is at the top of the dispensing unit. After removal of cap 7 from the supply container, and removal of the sealing cap 12 from the spout-forming member 10, the thin wall portion 10c' of the member 10 is punctured, and a limited amount of the volatile material 5 is poured through the layer of material 25 upon the corn cob pieces 29. The dispensing unit 6 remains in the position shown, and the deodorant or other liquid material involved progressively volatizes and permeates the surrounding atmosphere. The corn cob pieces 29 initially are saturated with the liquid, and by occasionally shaking the unit still-saturated covered pieces are brought to the top of the unit where the absorbed liquid now readily evaporates.

Figure 6:
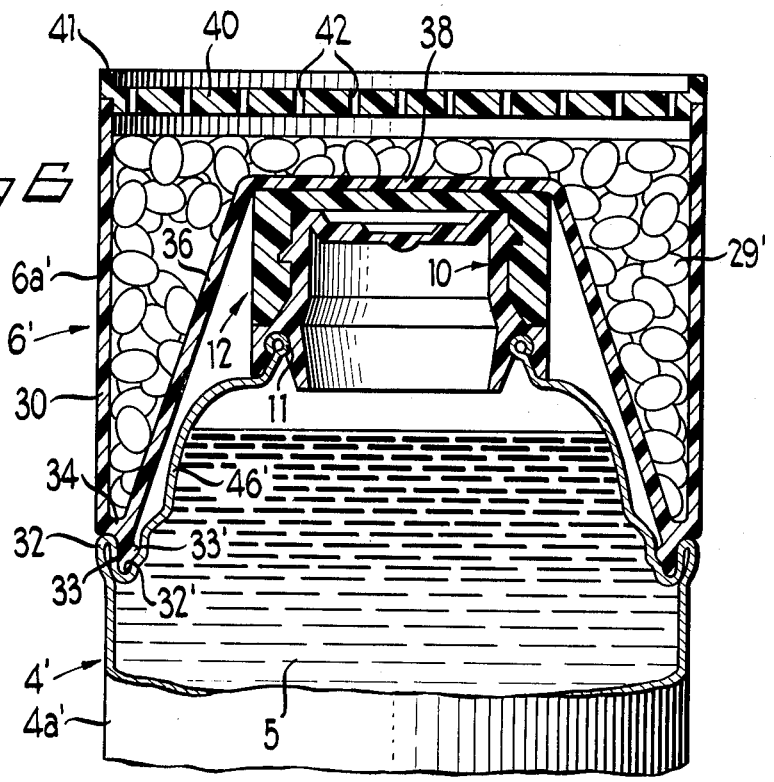
FIG. 6 is a greatly enlarged vertical sectional view of the upper end portion of a modified supply container and dispensing unit assembly where the dispensing unit is located at the upper end of the supply container.

To reduce the cost of the supply container and dispensing unit assembly just described, the dispensing unit of the preferred forms of the invention now to be described replaces the cap 7 in FIG. 1. Such a supply container and dispensing unit assembly 6' is shown in FIG. 6 to which reference should now be made. FIG. 6 shows a supply container 4' of somewhat different construction than the supply container 4 shown in FIG. 1 in that the supply container 4' includes an upper wall 4c' which forms an integral extension of the cylindrical main body portion 4a' of the supply container, rather than being a separate piece secured thereto by a beaded joint. The cylindrical body portion 4a' of the supply container 4' terminates at its upper end in a beaded rim 32 spaced slightly from the upper wall 4c' to define an upwardly opening annular channel 32'. The upper wall 4c' terminates in a beaded rim 11' over which the previously described pouring spout-forming member 10 is snap-fitted. A sealing cap 12 is threaded over the spout-forming member 10.

The dispensing unit 6' shown in FIG. 6 includes a housing 6a' containing a liquid-absorbent material 29' and comprises cylindrical side walls 30 which are in approximate alignment with the cylindrical body portion 4a' of the supply container 4' so that the attachment unit preferably appears as a vertical extension of the supply container for aesthetic reasons. The cylindrical walls 30 terminate at the bottom in a horizontal inwardly extending annular shoulder 34 which rests upon the beaded rim 32. A locking flange 33 projects downwardly from the inner margins of the annular shoulder 34 and includes an inwardly projecting annular projection 33' which releasably interlocks with the defining walls of the upwardly facing channel 32' of the supply container. The inner margins of the shoulder 34 of the housing 6' connect with an upwardly and inwardly inclined bottom wall 36 portion spaced from the side walls 30 and following the general contours of the reduced neck portion of the container formed by the upper wall 4c', the spout-forming member 10 and the inner sealing cap 12. The bottom wall portion 36 terminates in a horizontally extending raised bottom wall portion 38 which rests on or is continguous to the upper surface of the sealing cap 12. Confined between the bottom wall portion 36 of the dispensing unit housing 6a' and the cylindrical walls 30 thereof is an annular compartment which is filled with the liquid absorbent material 29'.

Before the housing 6a' is completed, the top of the cylindrical walls 30 is uncovered so as to form a large opening into which the liquid absorbing material 29' can be readily dropped into the housing 6a'. This opening is closed by a closure wall 40 which may be adhesively or otherwise secured to the upper marginal portion of the cylindrical walls 30. The closure wall 40 is provided with a series of apertures 42 into which the liquid volatile material may be poured into the supply container 4' after the attachment unit 6' and the inner sealing cap 12 are removed from the supply container and the depressed upper wall portion 10*c'* of the spout-forming member 10 is punctured.

The bottom surface of the downwardly extending locking flange 33 of the housing 6*a'* forms a support base which supports the dispensing unit 6' on a horizontal support surface, with the closure wall 40 of the housing 6*a'* extending in a generally horizontal plane. The closure wall 40 has an upwardly extending peripheral lip 41 forming a retaining well from which the volatile liquid poured therein can progressively drain through the apertures 42 in the closure wall 40, should the liquid be poured at a greater rate than the flow rate thereof through the apertures 42.

Figure 7:
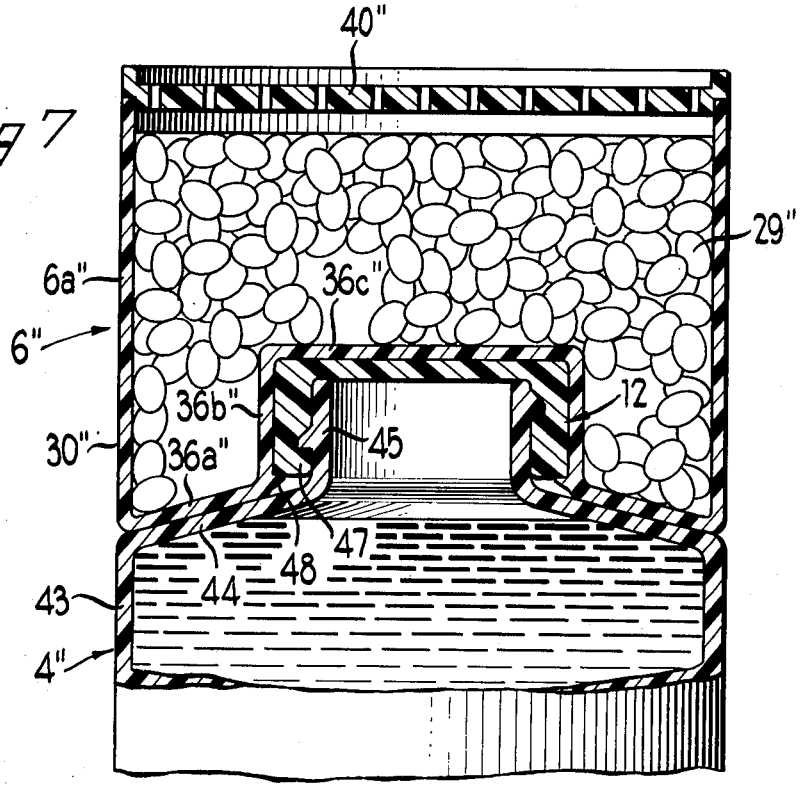
FIG. 7 is a greatly enlarged vertical sectional view of a further modified supply container and dispensing unit assembly.

The metal supply containers 4 and 4' shown in FIGS. 1 through 6 are of a construction and configuration commonly used as aerosol containers, and so are readily commercially available for use in the invention. (In these aerosol containers there is generally snap-fitted over the beaded rim 11 thereof a dispensing valve. In FIGS. 1 and 6, the spout-forming member 10 replaces this dispensing valve.) However, other forms of containers may be more desireable for the purposes of the present invention. In particular, it would be desireable to reduce the height of the upper end portion of the supply containers 4 and 4'. Refer now to FIG. 7 which shows such a supply container 4'' made of a molded synthetic plastic material and including cylindrical side walls 43 terminating at the top thereof in a slightly upwardly and inwardly inclining annular wall 44 terminating in a pouring spout-forming neck portion 45 which terminates at its upward end in a relatively short distance from the upper end of the cylindrical side walls 43. With such a shallow upper reduced end portion of the container 4'', for a given overall height of the supply container and dispensing unit assembly, the dispensing unit used therein can be provided with a larger compartment for holding a greater quantity of the liquid absorbing material 29'' involved. Referring to FIG. 7, the dispensing unit-forming attachment unit 6'' thereshown has a housing 6*a''* with cylindrical side walls 30'' and an upper closure wall 40'' of substantially the same size, shape and construction as the corresponding elements in the dispensing unit-forming attachment unit 6' shown in FIG. 6. However, the closure wall 40'' is spaced a much greater distance from the sealing cap 12 than the wall 40' in FIG. 6. The bottom end of the cylindrical walls 30'' of the housing 6*a''* joins a wall including portion 36*a''* closely hugging the upwardly and inwardly inclining wall portion 44 of the supply container 4'', an upwardly extending wall portion 36*b''* closely hugging the cylindrical outer surfaces of the sealing cap 12, and a horizontal central portion 36*c''* closely hugging the outer surface of the sealing cap 12. When sealing cap 12 is fully threaded over the spout-forming reduced neck portion 45 of the supply container 4'', it is still spaced from the inwardly inclining wall portion 44 of the supply container to define a downwardly facing shoulder 47 under which is snap-fitted an annular locking projection 48 extending inwardly from the bottom wall portion 36*b''* of the housing 6*a''*.

In the most preferred forms of the invention, the various dispensing units 6, 6' and 6'' are all snap-fitted on the upper or lower portions of the supply containers involved and form what appears to be a vertical continuation of the cylindrical side walls of the supply containers involved. These dispensing units are removed by simply pulling on the dispensing units in a direction longitudinally of the supply containers involved. Thereafter, either by dropping the dispensing units in place on a horizontal support surface or by inverting the same and placing the same on a horizontal support surface, these dispensing units are ready to receive the volatile liquid poured from the punctured portion of a pouring spout or from the open upper end of the supply container involved. However, it should be understood that numerous modifications may be made in the most preferred forms of the invention described without deviating from the broader aspects thereof.

We claim:

1. In combination with a supply container holding a supply of a volatile liquid material to be poured therefrom into a dispensing unit from which the material progressively disperses in a gaseous form to the surrounding atmosphere, said container having vertical side walls forming the main body portion of the container, a permanently sealed closure wall at the bottom of said main body portion and an upper end portion at the top of said body portion and including a section which is to form a pouring opening and which includes a closure cap for sealing and re-sealing the pouring opening after a portion of the contents of the container is poured therefrom; an attachment unit removably secured to one of the ends of the sealed container so as to form what appears to be a vertical extension thereof, said attachment unit forming a compartment containing a liquid-absorbent material and into which is to be poured said liquid material, the attachment unit having a base portion adapted to rest on a horizontal surface when removed from said container and aperture-forming means forming one or more apertures into which said liquid is poured from said pouring opening of said container and from which the gaseous form of said liquid material passes into the surrounding atmosphere when the base portion of said attachment unit is resting on said horizontal surface.

2. The combination of claim 1 wherein said attachment unit serves as a cover enclosing and hiding from view said upper end portion of said container.

3. The combination of claim 1 wherein said base portion of said attachment unit makes interlocking engagement with said container.

4. The combination of claim 1 wherein the end of said attachment unit having said aperture-forming means makes interlocking engagement with said container.

5. The combination of claim 1 wherein when the attachment unit is mounted in place on the upper end portion of said container and has a horizontal wall at the top thereof forming said aperture-forming means with one or more apertures communicating with said compartment of the attachment unit.

6. The combination of claim 1 wherein said attachment unit is removably secured to the bottom end of said container and there is provided a second removable attachment unit forming a cover for the upper end portion of said container and forming what appears to be a vertical extension of said container and appearing to be a mirror-image of the dispensing unit-forming attachment at the bottom end of the container.

7. The combination of claim 5 wherein said attachment unit makes a snap-fitting removable locking engagement with one end of said container.

8. In combination with a supply container holding a supply of a volatile liquid material to be poured therefrom into a dispensing unit from which the material progressively disperses in a gaseous form to the surrounding atmosphere, said container having side walls forming the main body portion of the container, a permanently sealed closure wall at the bottom of said main body portion and an upper end portion at the top of said body portion and including a section which is to form a pouring opening and which includes a closure cap for sealing and re-sealing the pouring opening after a portion of the contents of the container is poured therefrom; a dispensing unit-forming attachment unit removably secured over the top of said supply container and enclosing the upper end portion thereof, the attachment unit having a base portion adapted to rest on a horizontal support surface when removed from said container, aperture-forming means forming one or more apertures and into which said liquid is poured from said pouring opening of said container and from which the gaseous liquid material passes into the surrounding atmosphere when the base portion of said attachment unit is resting on said horizontal support surface, and a compartment communicating with said aperture or apertures with a liquid-absorbent material therein.

9. The combination of claim 8 wherein the dispensing unit-forming attachment unit has side walls in substantial alignment with the side walls of the main body portion of the container so that the attachment unit appears to be a vertical continuation of said side walls.

10. The combination of claim 8 wherein said upper end portion of said supply container is of narrower extent than said main body portion thereof so that the upper end portion forms a reduced neck portion of the supply container, said attachment unit having side walls spaced from said reduced neck portion of the supply container below the upper portion of said reduced neck portion thereof and further having bottom walls extending from said side walls which bottom walls follow the general contour of said reduced neck portion of said supply container to define with said side walls an annular compartment forming at least part of said compartment containing said liquid absorbent material.

11. The combination of claim 8 wherein said closure cap when fully applied over the section of the container which is to form a pouring opening has at the bottom thereof an exposed downwardly facing shoulder, and said attachment unit has projecting means making a releasable snap-fitting relationship with said downwardly facing shoulder of the closure cap.

12. The combination of claim 10 wherein said attachment unit on the upper end portion of said supply container has an upper apertured wall containing said one or more apertures into which the volatile liquid is poured when the attachment unit is removed from the supply container and rests on said horizontal support surface.

13. The combination of claim 12 wherein said attachment unit makes a snap-fitting engagement with the container body.

* * * * *